US006776642B1

(12) United States Patent
McHugh et al.

(10) Patent No.: US 6,776,642 B1
(45) Date of Patent: Aug. 17, 2004

(54) ELECTRICAL CONNECTOR ASSEMBLY HAVING METAL CLIP FOR PRESSING LOADED LGA IC MODULE

(75) Inventors: Robert G. McHugh, Golden, CO (US); Hao-Yun Ma, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/620,637

(22) Filed: Jul. 15, 2003

(51) Int. Cl.[7] ..... H01R 13/62
(52) U.S. Cl. ..... 439/331; 439/71; 439/525
(58) Field of Search ..... 439/71–73, 328–331, 439/525–526

(56) References Cited

U.S. PATENT DOCUMENTS 4,504,105 A 3/1985 Barkus et al.
4,621,884 A 11/1986 Berkebile, Jr. et al.
4,692,790 A 9/1987 Oyamada
5,344,334 A 9/1994 Laub et al.
5,588,847 A * 12/1996 Tate ..... 439/71
6,244,875 B1 * 6/2001 McHugh et al. ..... 439/73
6,471,533 B2 * 10/2002 Lai et al. ..... 439/331

* cited by examiner

*Primary Examiner*—Truc Nguyen
(74) *Attorney, Agent, or Firm*—Wei Te Chung

(57) ABSTRACT

An electrical connector assembly (1) includes a base (10), a fixing member (11), and a clip (13). The base defines at least one installation portion (12, 15). The fixing member is pivotally engaged with the installation portion, and comprises an actuator (110) movably engaged in the at least one installation portion. The clip is attached to the base opposite from the at least one installation portion, and comprises a groove (130) defining a first corner (131) and a second corner (132) adapted to cooperate with the actuator. The actuator can slide from the first corner to the second corner when the fixing member engages with the clip, whereby no lateral movement of the clip relative to the base occurs. Thus, a LGA IC module (2) can be fixed on the electrical connector assembly reliably.

6 Claims, 5 Drawing Sheets

ELECTRICAL CONNECTOR ASSEMBLY HAVING METAL CLIP FOR PRESSING LOADED LGA IC MODULE

BACKGROUND OF THE INVENTION

1. Field of the Invention

The present invention relates to an electrical connector assembly used for electrically connecting a land grid array (LGA) integrated circuit (IC) module to a printed circuit board (PCB).

2. Description of the Prior Art

An electrical connector assembly used for electrically connecting an LGA IC module to a PCB is widely applied in the field of electronics, and a correlative article is found in Nonlinear Analysis Helps Design LGA Connectors (Connector Specifier, February 2001). A conventional electrical connector assembly of this kind comprises a base, a metal clip assembled with the base, and a load lever mounted on the base to engage with the metal clip. Examples of this kind of electrical connector assembly are disclosed in U.S. Pat. Nos. 4,504,105, 4,621,884, 4,692,790, and 5,344,334.

FIG. 4 shows a conventional electrical connector assembly 6 comprising a base 63, a fixing member 62 assembled with the base 63, and a metal clip 64 engaged with the base 63. The metal clip 64 has a groove 644, and is pivotably attached to one side of the base 63. The fixing member 62 is pivotably attached to an opposite side of the base 63. The fixing member 62 comprises an actuator 620, and an operation handle 622 perpendicularly extending from the actuator 620. The actuator 620 defines two pivot portions 623, and an offset action portion 621 positioned therebetween. When the electrical connector assembly is used, the metal clip 64 is actuated to a vertical position, an LGA IC module 7 is positioned within the base 63 under the metal clip 64, and then the metal clip 64 is actuated to press on the LGA IC module 7. Driven by the operation handle 622, the action portion 621 moves into the groove 644 of the metal clip 64 and presses the metal clip 64 onto the IC module 7. Thus the metal clip 64 is firmly fastened on the IC module 7, and the IC module 7 is fixed on the electrical connector assembly reliably. However, during the course of rotation of the operation handle 622, the metal clip 64 moves in the direction indicated by arrow "A", because of the cooperation between the action portion 621 and the groove 644. This can result in the IC module 7 moving in the direction of arrow "A" because of the frictional engagement between the IC module 7 and the fixing member 62. When this happens, the IC module 7 is not properly retained in the base 63.

Hence, a new electrical connector assembly having a new structure is desired to overcome the above-described disadvantages.

SUMMARY OF THE INVENTION

An object of the present invention is to provide an electrical connector assembly having effective means for reliably positioning an IC module thereon.

In order to achieve the aforementioned object, an electrical connector assembly in accordance with a preferred embodiment of the present invention comprises a base, a fixing member, and a clip. The base defines at least one installation portion. The fixing member is pivotally engaged with the installation portion, and comprises an actuator movably engaged in the at least one installation portion. The clip is attached to the base opposite from the at least one installation portion, and comprises a groove defining a first corner and a second corner adapted to cooperate with the actuator. The actuator can slide from the first corner to the second corner when the fixing member engages with the clip, whereby no lateral movement of the clip relative to the base occurs. Thus, a LGA IC module can be fixed on the electrical connector assembly reliably.

Other objects, advantages and novel features of the present invention will become more apparent from the following detailed description when taken in conjunction with the accompanying drawings.

DESCRIPTION OF THE PREFERRED EMBODIMENT

Figure 1:
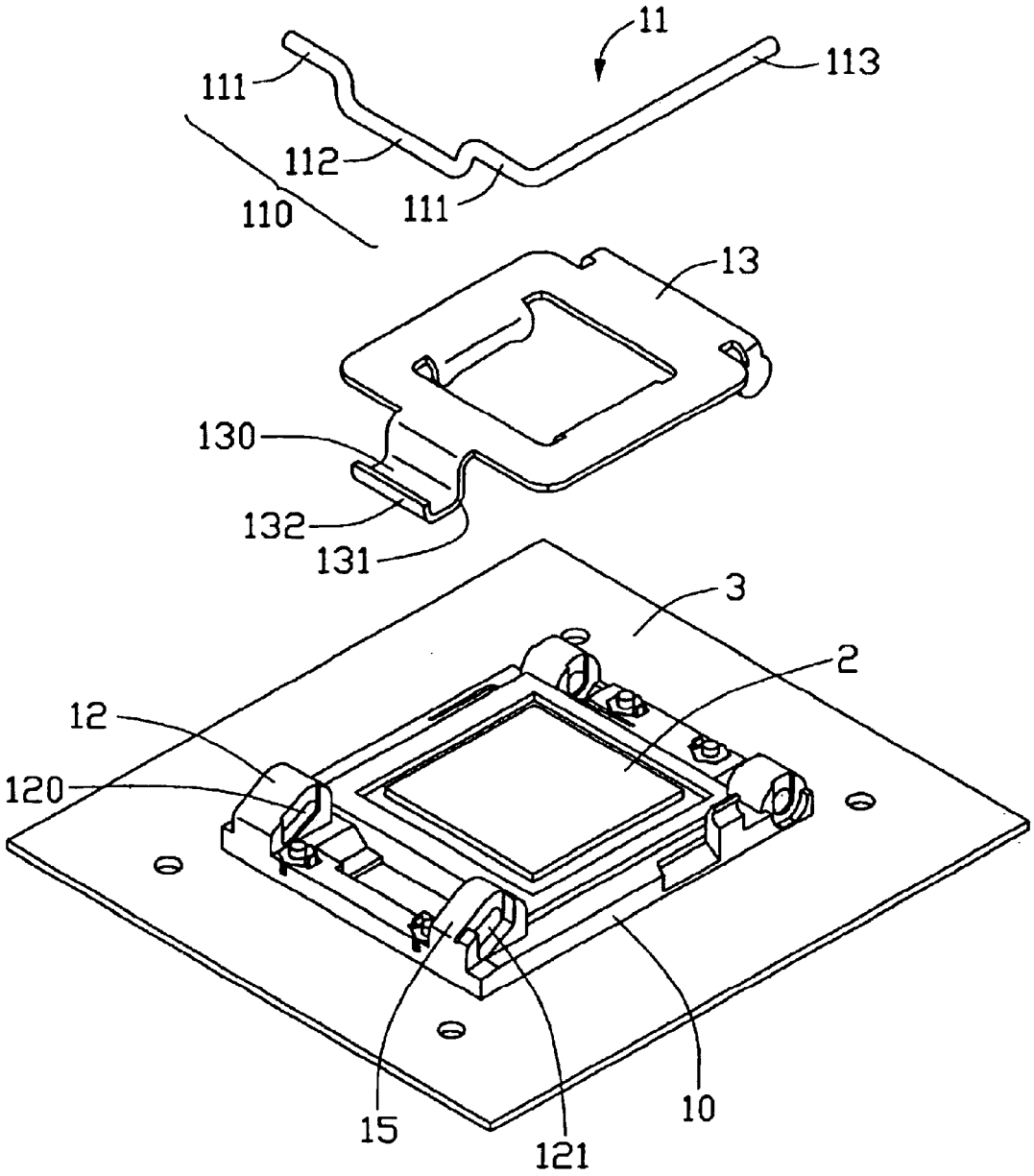
FIG. 1 is an exploded, isometric view of an electrical connector assembly in accordance with the preferred embodiment of the present invention, showing a base of the assembly mounted on a PCB, and an IC module positioned on the base.

Reference will now be made to the drawing figures to describe the present invention in detail.

Figure 2:
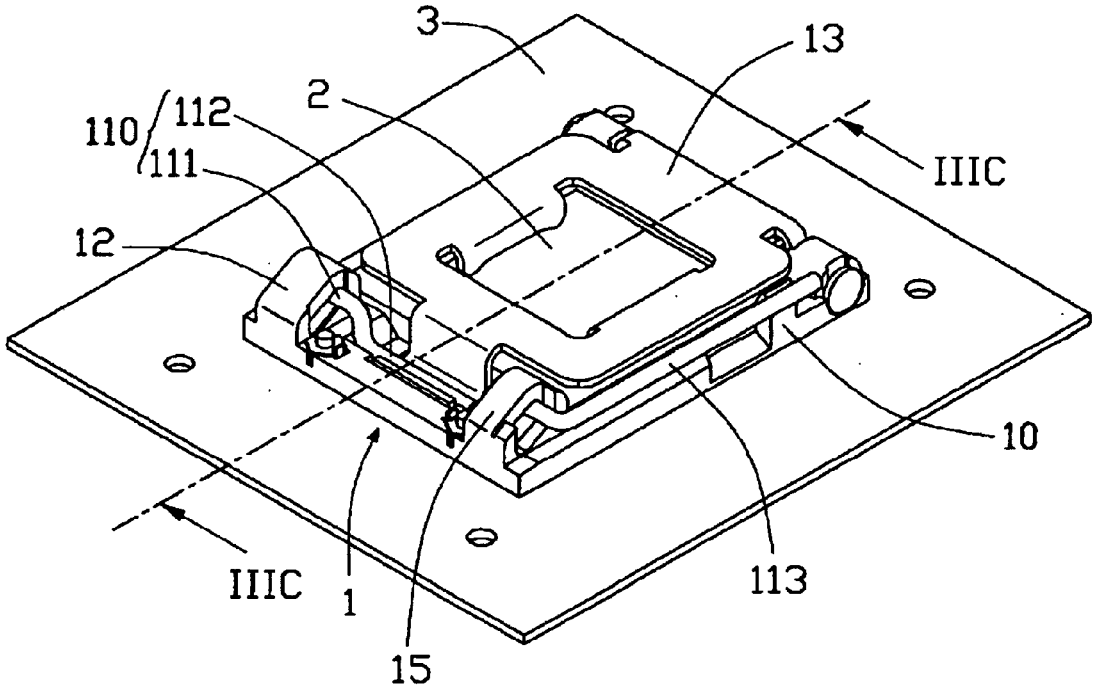
FIG. 2 is an assembled view of FIG. 1, showing the IC module secured in the electrical connector assembly.

Referring to FIGS. 1 and 2, an electrical connector assembly 1 in accordance with a preferred embodiment of the present invention is adapted to electrically connect a land grid array (LGA) integrated circuit (IC) module 2 to a printed circuit board (PCB) 3. The electrical connector assembly 1 comprises a base 10, a fixing member 11 movably attached with the base 10, and a metal clip 13 movably attached with the base 10. The metal clip 13 defines a groove 130 at an end thereof, thereby defining a first corner 131 and a second corner 132 at the groove 130. A distance between the first and second corners 131, 132 is predetermined. The metal clip 13 is hinged with a first end of the base 10, and the fixing member 11 is attached to an opposite second end of the base 10. The fixing member 11 comprises an actuator 110, and an operation handle 113 perpendicularly extending from the actuator 110. The actuator 110 comprises two pivot portions 111, and an offset action portion 112 parallel to and interconnecting the pivot portions 111. The action portion 112 is adapted to cooperate with the groove 130 of the metal clip 13. The second end of the base 10 forms a first installation portion 12 defining a first pivot hole 120 therein, and a second installation portion 15 defining a second pivot hole 121 therein. The first and second pivot holes 120, 121 have a same profile, being rectangular with rounded ends. The first and second pivot holes 120, 121 form a same oblique angle relative to the base 10.

Figure 3A:
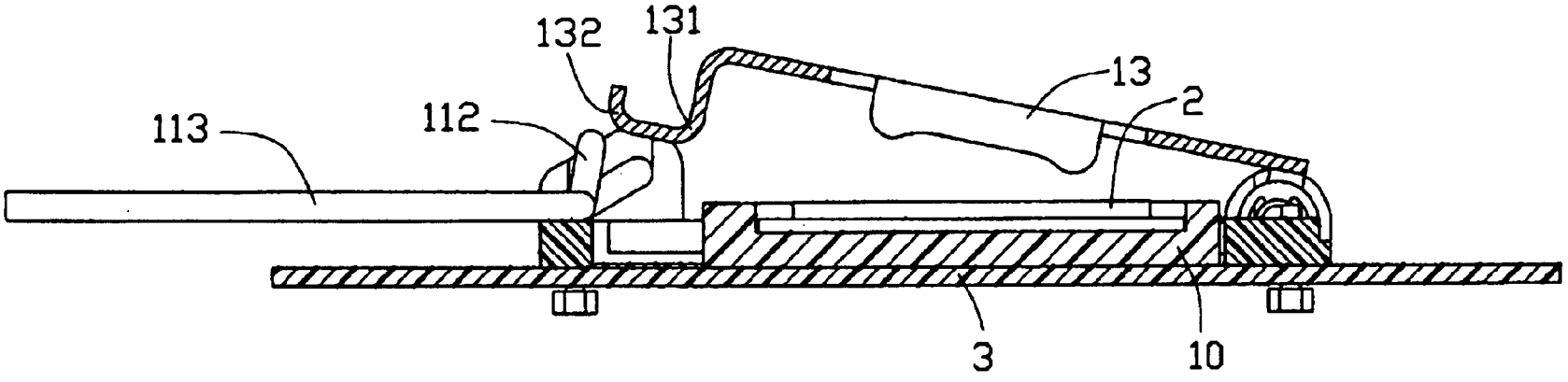
FIGS. 3A and 3B are similar to FIG. 3C, but showing successive stages in operation of the electrical connector assembly prior to reaching the state as shown in FIG. 3C.
Figure 3B:
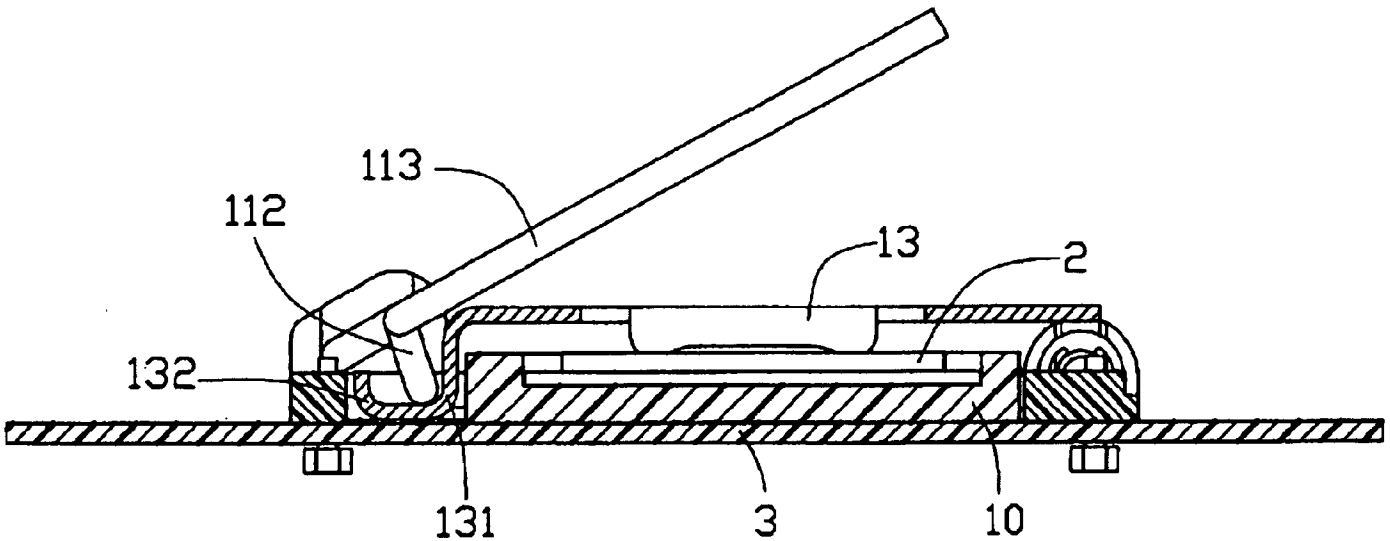
Figure 3C:
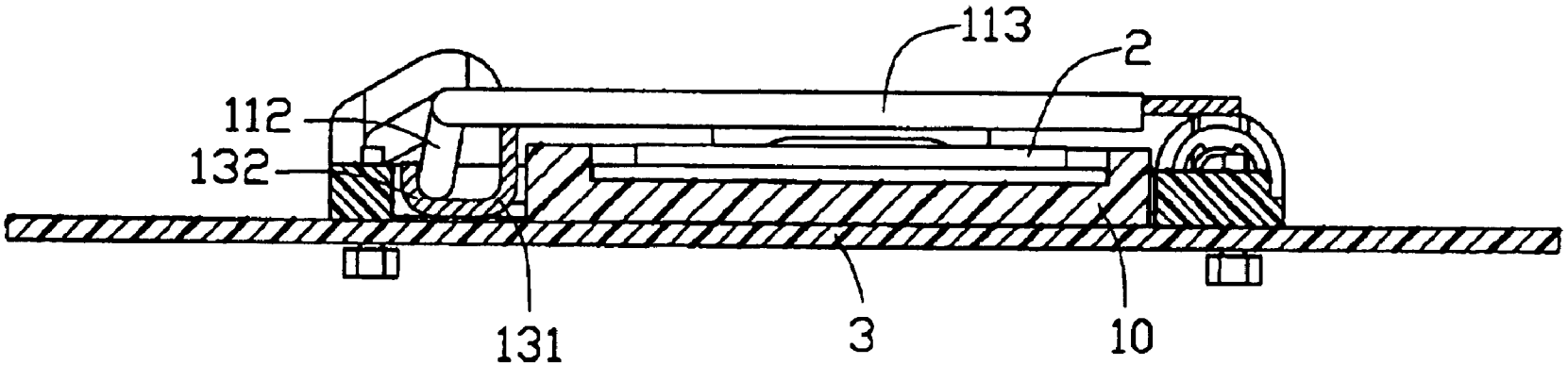
FIG. 3C is a schematic cross-sectional view taken along line IIIC—IIIC of FIG. 2.
Figure 4:
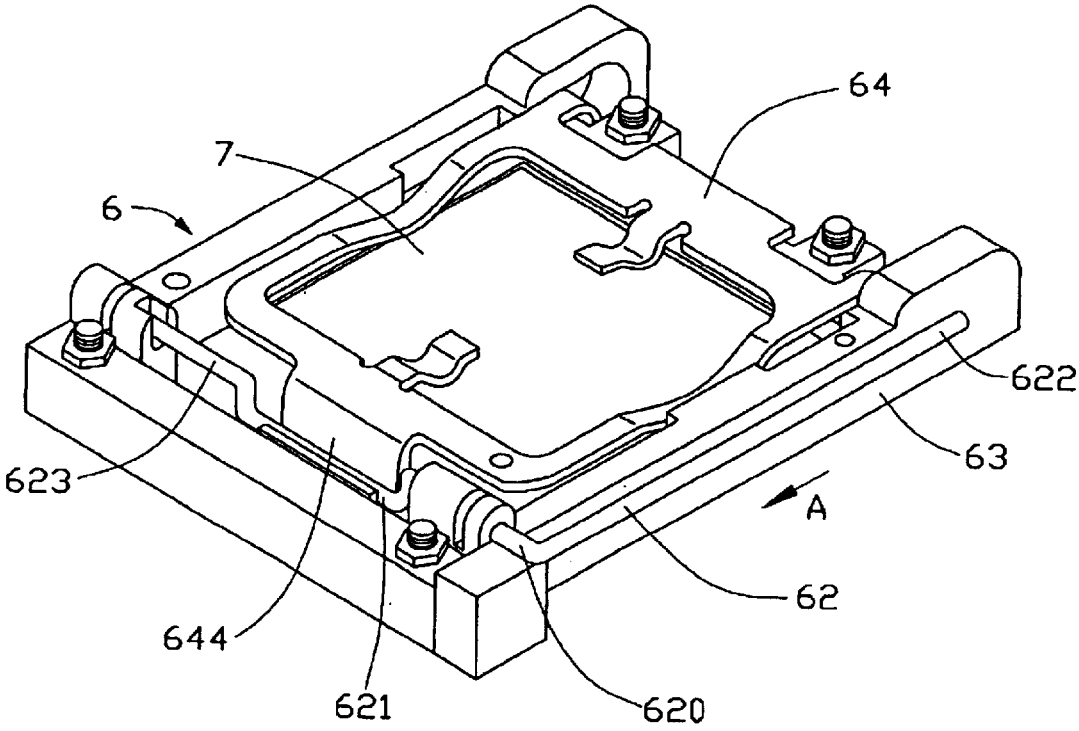
FIG. 4 (PRIOR ART)
FIG. 4 is an isometric view of a conventional electrical connector assembly.

Referring to FIG. 2 in conjunction with FIGS. 3A to 3C, when the fixing member 11 and the base 10 are assembled together, the actuator 110 is movably attached to the first and second installation portions 12, 15. The pivot portions 111 are pivotably engaged in the first and second pivot holes 120, 121 respectively. When the electrical connector assembly 1 is manually operated, the metal clip 13 is rotated to a vertical position, and the LGA IC module 2 is positioned on the base 10. The metal clip 13 is then rotated to loosely rest on the LGA IC module 2. Driven by the operation handle 113, the action portion 112 moves into the groove 130 of the metal clip 13 and presses the metal clip 13 on the LGA IC module 2.

During operation of the operation handle 113, firstly, the pivot portions 111 are located in bottoms of the first and second pivot holes 120, 121 respectively. The metal clip 13 loosely rests on the LGA IC module 2. The action portion 112 then moves into the groove 130 of the metal clip 13 without engaging with the metal clip 13. Then, the action portion 112 engages in the first corner 131 of the groove 130 and urges the metal clip 13 downwardly. Therefore, the metal clip 13 firmly presses on the LGA IC module 2. Simultaneously, the pivot portions 111 slide to tops of the first and second pivot holes 120, 121 respectively. Finally, the action portion 112 freely slides from the first corner 131 to the second corner 132. Because of the predetermined distance between the first and second corners 131, 132, the metal clip 13 does not move laterally relative to the LGA IC module 2. No corresponding frictional engagement between the metal clip 13 and LGA IC module 2 occurs. As a result, the LGA IC module 2 remains in its correct position on the base 10.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector assembly used for retaining and electrically connecting an integrated circuit module to a printed circuit board, the electrical connector assembly comprising:

a base defining at least one installation portion;

a fixing member pivotally engaged with the installation portion, and comprising an actuator movably engaged in the at least one installation portion, the actuator comprises two pivot portions, and an offset intermediate action portion parallel to the pivot portions; and a clip attached to the base opposite from the at least one installation portion, the clip comprising a groove defining a first corner and a second corner to receive the offset action portion, wherein the offset action portion can slide from the first corner to the second corner when the fixing member engages with the clip, whereby no lateral movement of the clip relative to the base occurs.

2. The electrical connector assembly as described in claim 1, wherein the fixing member further comprises an operation handle approximately perpendicular to the actuator.

3. An electrical connector assembly comprising:

a base defining a first installation portion having a first pivot hole therein and a second installation potion having a second pivot hole therein;

a fixing member comprising an actuator pivotably engaged in the first and second pivot holes of the base, and a operational handle; and a clip movably attached to the base opposite from the first and second installation portions, the clip defining a groove adapted to cooperate with the actuator;

wherein during rotation of the operational handle, the actuator slides along the first and second pivot holes of the base and the groove of the clip, for preventing lateral movement of the clip relative to the base; and wherein a profile of each of the first and the second pivot holes is rectangular with rounded ends, and the first and the second pivot holes each form an oblique angle relative to the base.

4. The electrical connector assembly as described in claim 3, wherein the operation handle of the fixing member is generally perpendicular to the actuator.

5. The electrical connector assembly as described in claim 4, wherein the actuator comprises two pivot portions, and an offset intermediate action portion parallel to the pivot portions.

6. The electrical connector assembly as described in claim 5, wherein the groove defines a first corner and a second corner adapted to cooperate with the action portion.

* * * * *